United States Patent [19]

Nolte et al.

[11] Patent Number: 4,501,241

[45] Date of Patent: Feb. 26, 1985

[54] GOVERNOR FOR A DIESEL ENGINE

[75] Inventors: Albert Nolte; Gerd Wallenfang, both of Cologne, Fed. Rep. of Germany

[73] Assignee: Klöckner-Humboldt-Deutz AG, Cologne, Fed. Rep. of Germany

[21] Appl. No.: 477,893

[22] Filed: Mar. 23, 1983

[30] Foreign Application Priority Data

Mar. 25, 1982 [DE] Fed. Rep. of Germany ..... 3210903

[51] Int. Cl.[3] ..... F02D 31/00

[52] U.S. Cl. ..... 123/367; 123/383; 251/141

[58] Field of Search ..... 123/367, 380, 382, 383, 123/387; 251/141, 139

[56] References Cited

U.S. PATENT DOCUMENTS

| | | | |
|---|---|---|---|
| 2,374,411 | 4/1945 | Camner | 123/383 |
| 2,979,643 | 4/1961 | Wilde et al. | 251/141 |
| 3,435,813 | 4/1969 | Wagner | 123/383 |
| 3,484,076 | 12/1969 | Naumann | 251/141 |
| 4,174,694 | 11/1979 | Wessel et al. | 123/382 |
| 4,343,276 | 8/1982 | Jaliwala et al. | 123/367 |

FOREIGN PATENT DOCUMENTS

| | | | |
|---|---|---|---|
| 2650247 | 5/1979 | Fed. Rep. of Germany . | |
| 5131 | 1/1979 | Japan | 123/382 |
| 2067663 | 7/1981 | United Kingdom | 123/383 |
| 914791 | 3/1982 | U.S.S.R. | 123/383 |

*Primary Examiner*—Magdalen Y. C. Moy

*Attorney, Agent, or Firm*—Watson, Cole, Grindle & Watson

[57] ABSTRACT

A governor for adjusting a control-rod stop in a fuel-injection pump for an internal combustion engine. A controlling element is provided on the control-rod stop of the fuel injection pump, to which a throttled pressure fluid is fed, the discharge of which is controlled by a proportionally operating solenoid valve. An equilibrium prevails in the solenoid valve between the magnetic field applied to the solenoid armature and the compressive forces of the pressurized fluid. Depending on the magnitude of the respective forces, a larger or smaller discharge area can be unblocked thereby releasing or spilling the pressurized fluid.

7 Claims, 4 Drawing Figures

GOVERNOR FOR A DIESEL ENGINE

BACKGROUND OF THE INVENTION

1. Field of the Invention

The invention relates generally to a governor and more particularly to a governor for a diesel engine wherein a fuel injection pump is controlled as a function of engine operating parameters. An attachment on the governor of the fuel injection pump limits the distance through which a control rod moves, thereby limiting the corresponding delivery of fuel during starting and/or full load conditions. The attachment may also include a torque control device.

2. Description of the Prior Art

Unexamined West German Patent Application 2650247 is generally directed to the subject matter of the present invention and discloses the adjustment of a control-rod stop of a fuel injection pump as a function of various operating parameters which are continuously recorded and evaluated against predetermined values in order to optimize performance of the internal combustion engine without overloading or risk of damage. In this way, the life of the internal combustion engine can be lengthened and the conventional blocking of the control-rod stop at a predetermined value becomes unnecessary, regardless of the field and mode of application of the internal combustion engine. The control rod stop is an attachment on the governor of a fuel injection pump designed to limit the distance through which the control rod moves, thereby limiting the fuel delivery rate.

However, unexamined West German Patent Application 2650247 requires many control elements to control the fluid which modulates the control rod stop such as accumulators and electromagnetically operating directional control valves. Each of these elements presents sources of error or trouble, such as hysteresis and position errors on the helices or control edges of the fuel injector plunger which accumulate to a total system error so that accurate operation of the governor is not ensured. The control edges are located on spill grooves formed in the fuel injection plungers. The spill grooves are typically of helical form and may be disposed in upper or lower portions of the plunger or both and may be of the same spiral direction or opposite and may be provided on both sides of the plunger.

SUMMARY OF THE INVENTION

It is an object of the invention to improve the above-noted type of governor in such a way that it operates with precision. This object is achieved according to the teachings of the present invention by disposing a solenoid valve within the flow path of a pressurized control fluid downstream from a controlling unit so as to gradually shut off the control fluid. The advantage of the present invention is that the control rod stop is adjusted by spilling or diverting the pressurized fluid and not, as in the past, by metering it. In this way, it is possible to feed the fluid at varying pressures by, for example, a pump driven by the internal combustion engine because, as a result of the spilling, the pressure variations can be absorbed. Thus, the hydraulic accumulator and other control elements can be dispensed with, thereby resulting in fewer sources of error and thus reducing trouble and error within the system.

The solenoid valve armature may act as a piston as will be later described. The novel design of this solenoid valve allows for the elimination of other auxiliary control elements. The solenoid valve operates in a substantially fully proportional mode. The solenoid valve has only a minimal hysteresis which has virtually no deleterious influence on the accuracy of operation. The solenoid valve of the present invention is distinguished by requiring a minimum number of strokes sufficient for the adjustment of the control-rod stop. With this construction, only an equilibrium between the fluid and the magnetic force which, in turn, is dependent upon the field strength of the solenoid, is simply achieved. Since no spring need be provided within the solenoid valve, it is not necessary to overcome a spring force so that both minimal pressures in the fluid and small electric currents suffice for proper functioning of the fuel injection pump governor.

According to the invention, it is even possible to use charge air from the pressurized air charge of a supercharger or to use the pressurized air charge in the intake manifold as the pressurized control fluid. A supercharger is a compressor which compresses the intake air before delivering it to the working cylinders of the engine in order to increase the air charge. However, with the above-noted supercharger construction, it is necessary to provide a fixed restrictor such as a non-adjustable orifice or restrictor acting as a fixed-value throttle in the direction of flow of the fluid upstream from a controlling element such as a manifold-pressure compensator so as to obtain a stable controlled system. Thus, it is possible to simply discharge into the atmosphere the charge-air pressure acting upon the solenoid valve so that return lines are no longer needed.

The controlling element of the present invention can be utilized as a manifold-pressure compensator of known construction such as used in the art to adjust the control-rod stop using the charge-air pressure of, for example, a supercharger. The manifold pressure compensator may be an aneroid device such as a full-load control rod stop for a governor controlled by the charge-air pressure. The manifold pressure compensator reduces the full load delivery of fuel in lower engine speed ranges when the charge-air pressure is low. In this case, the controlling element retains the original function, because the charge-air pressure can be used as another operating parameter to control the control-rod stop.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference characters designate like or corresponding parts through the several views and wherein.

DETAILED DESCRIPTION OF THE PREFERRED EMBODIMENT

Figure 1:
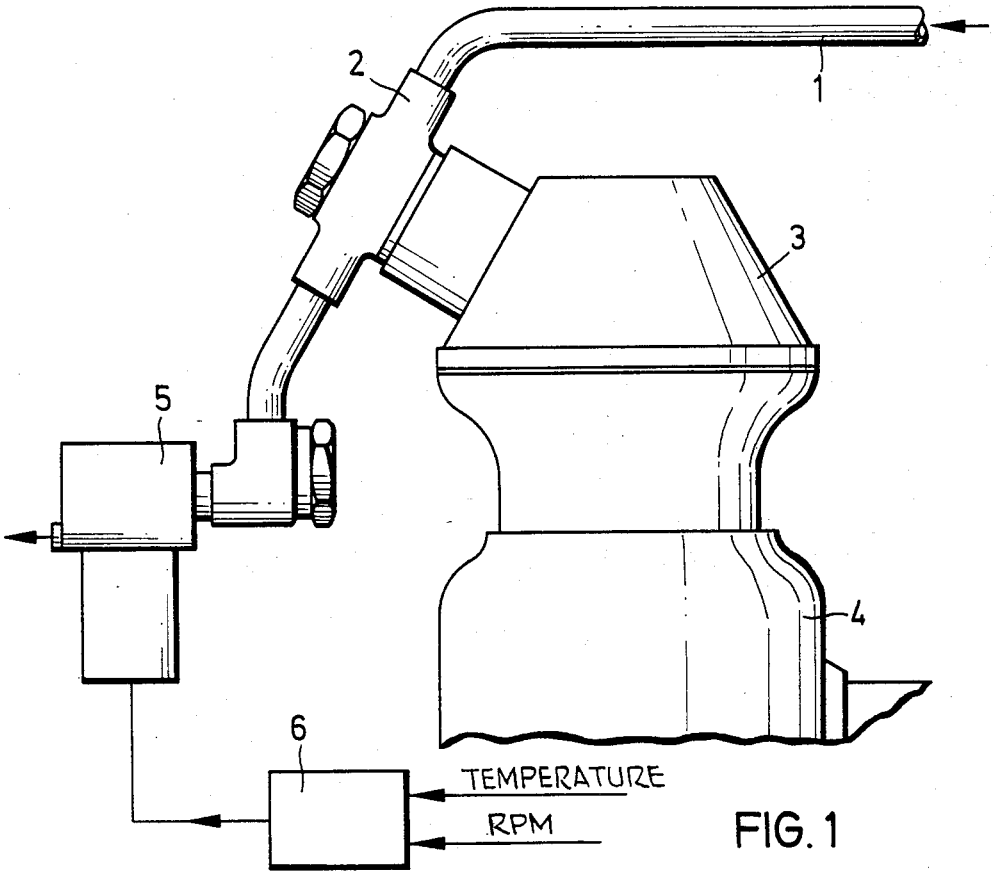
FIG. 1 is a schematic representation of the governor according to the invention.

FIG. 1 is a schematic representation of the present invention. On a supercharger of an exhaust turbo-supercharger, a pipe 1 is connected via a fixed non-adjustable restrictor 2 to a controlling element 3 which is attached to the fuel-injection pump 4 of an internal combustion engine (not shown). The controlling element 3 is designed as a manifold-pressure compensator and is connected to a control-rod stop for operational purposes. Pipe 1 is connected from the controlling element 2 to the solenoid valve 5 which controls the pressure prevailing in the controlling element 3 by discharging such pressure into the atmosphere.

The solenoid valve 5 is connected electrically to a governor 6 which records various engine operating parameters such as critical engine component temperatures and RPM's by suitable sensors and compares such operating parameters with predetermined values. The solenoid valve 5 is controlled by the governor 6 in such manner that the control-rod stop of the fuel injection pump always releases a precise maximum quantity of injected fuel. Thus, it is possible to set to a higher power output level internal combustion engines which are incorporated, for example, into trucks and used for operation on the so-called "stop-and-go" principle, thus running only with a relatively low load. In the case of a longer and higher load, the controlling element 3 is regulated by the govenor 6 and the solenoid valve 5 in such a way that the control-rod stop is adjusted toward a smaller maximum quantity of fuel injected.

Figure 2:
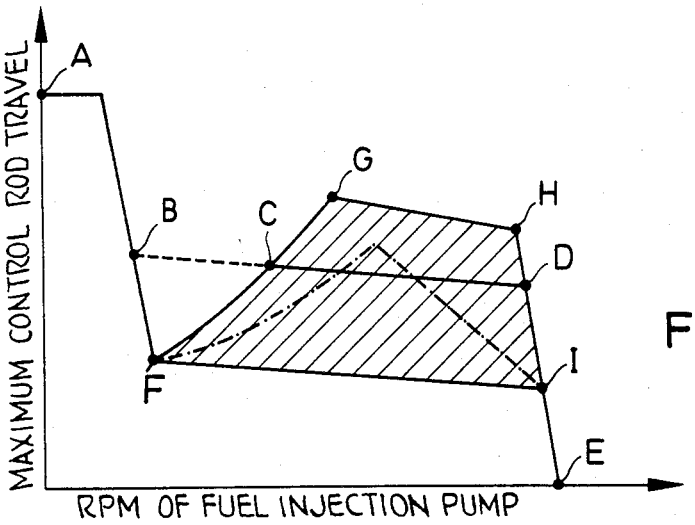
FIG. 2 is a graphic representation of the control-rod range which can be achieved with the invention.

FIG. 2 is a diagram showing the control-rod travel versus the RPM of the fuel-injection pump in which the maximum control-rod travel has been plotted. The curve runs through points A, B, C, D and E when the pressure-charged internal combustion engine is operated without the controlling element 3. The curve runs through A, F, C, D and E if the supercharged internal combustion engine is equipped with a commercial manifold-pressure compensator, for with a supercharged internal combustion engine the fuel delivery at full load is tuned to the charge-air pressure. However, in the lower speed range the charge-air pressure is lower and, thereby, the weight of the air charge in the engine cylinders is lower. Therefore, the fuel delivery rate at full load must also be adapted in a corresponding ratio to the reduced weight of the air. This function is performed by the manifold-pressure compensator, because it reduces the fuel delivery at full load in the lower speed range from a preselected charge-air pressure value on.

Another result of the present invention is that the curve can assume any shape in the F, G, H, I area as shown, for example, by the dash-dot line. The operation of controlling element 3 as well as of the manifold-pressure compensator remains unaffected thereby.

Figure 3:
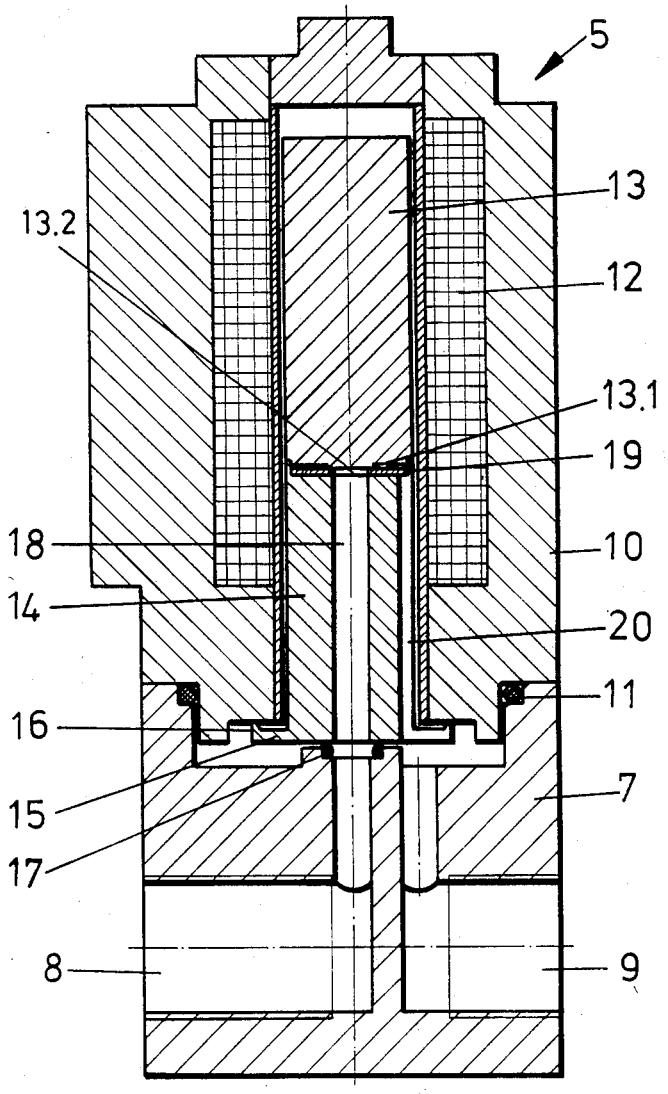
FIG. 3 shows a cross section of the solenoid valve according to the invention.

FIG. 3 shows in greater detail the solenoid valve 5 in a preferred embodiment of the invention. It is composed of the connecting flange 7 into which pipe 1 enters at point 8 and from which, at point 9, an outlet pipe—if charge—air is used as a pressure fluid—discharges into the atmosphere at a suitable point. Housing 10 of the solenoid valve 5 proper is fastened upon the connecting flange 7 using sealant 11. Coil 12 is located in housing 10 which contains an armature 13. Between armature 13 and flange 7 there is mounted a cylinder 14 which, via flange 15 with a raised circumferential triangular rim 16 using another sealant 17, is pressed in between flange 7 and housing 10. Circular cylinder 14 has a central bore 18 which guides the fluid from flange 7 to the end face 13.1 of armature 13 turned toward circular cylinder 14. Armature end face 13.1 has a flat shoulder portion 13.2 which closes bore 18 by coaction with a seal plate 19. On the periphery of circular cylinder 14 there is provided a longitudinal groove 20 over which the fluid in flange 7 can flow to the discharge pipe at point 9.

The pressure of the fluid acts upon shoulder 13.2 during the operation of the solenoid valve 5. Depending on the strength of the magnetic field applied thereto, armature 13 may or may not be lifted by the fluid. This results in the formation of an outlet having a predetermined cross sectional area between shoulder 13.2 and seal plate 19 under certain operating conditions. This results in a reduction in the pressure in pipe 1 and, thus, in controlling element 3 so that the control-rod stop is correspondingly adjusted. The governor 6 is designed in such a way that in the event of a power failure the control-rod stop is adjusted to an idle fuel delivery rate.

Figure 4:
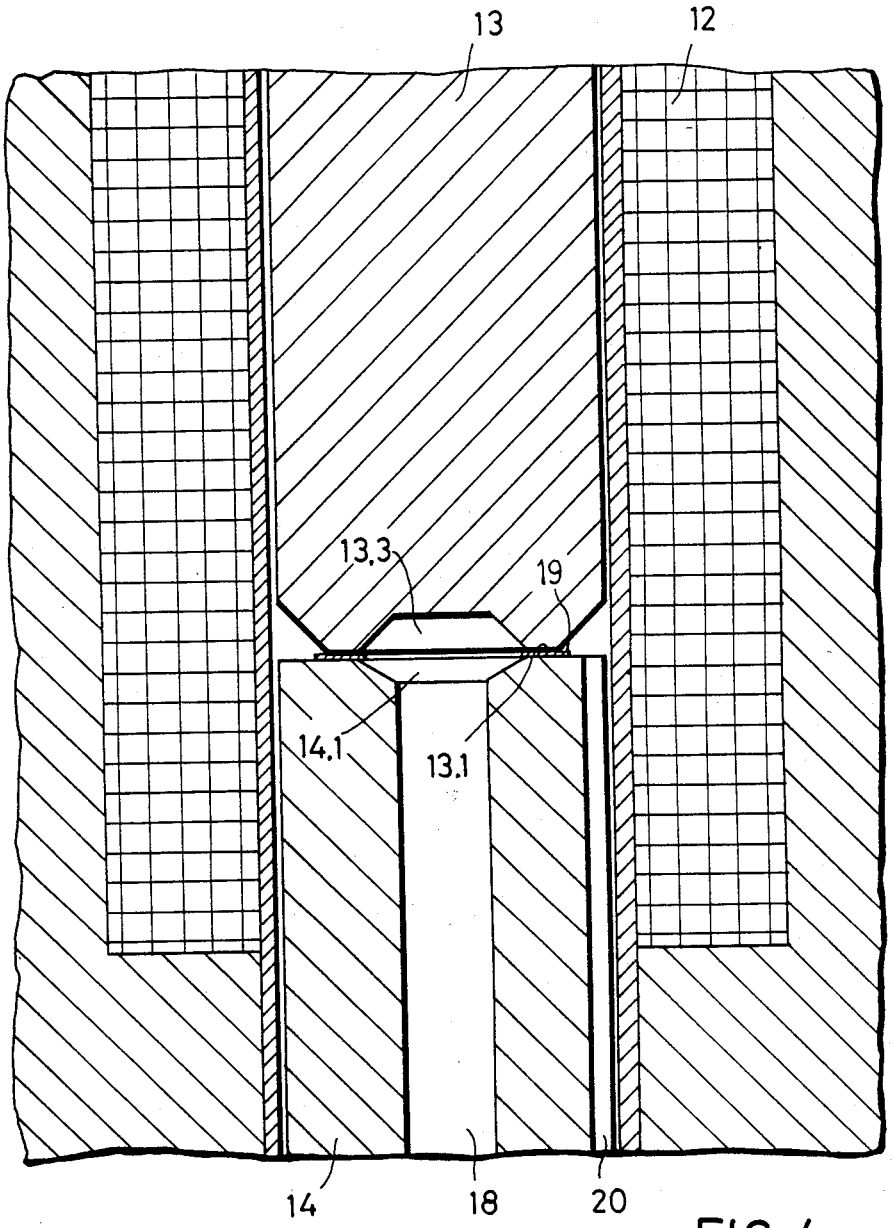
FIG. 4 is an alternative embodiment of the solenoid valve according to the invention.

FIG. 4 shows in cross section a cutout view of an alternative embodiment of the solenoid valve according to the invention. In this case, an armature end face 13.1 and an end face of cylinder 14 are each respectively provided with a chamfered recess 13.3, 14.1 so that the effective pressure area is enlarged compared with that of the embodiment of FIG. 3. This configuration reduces pressure variations on the armature end face 13.1 during engine operation. Otherwise, the advantages and functions of the solenoid valve of FIG. 4 are similar to those shown in FIG. 3.

It should be noted that fuel or lubricating oil may also be used as the pressurized fluid. In this case, the discharge pipe must be returned at point 9 to the respective supply tanks.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. In a governor system for a fuel injection pump of a diesel engine, the governor system including an adjustment means for adjusting the position of an adjustable stop for a movable control rod of the fuel injection pump, the adjustment means being connected to a pipe means through which pressurized fluid flows in one direction, the operation of the adjustment means being based on the pressure of the fluid in the pipe means, and the pressure of the fluid in the pipe means being in turn based on various operating parameters of the engine, the improvement wherein said adjustment element is connected along the length of the pipe means, such that the pipe means has an upstream portion and a downstream portion with respect to said adjustment element, a spring-less solenoid valve connected to the downstream portion of said pipe means which is capable of controlling the pressure of the fluid in said pipe means by blow off through a discharge port, said solenoid valve including a flow channel therethrough which connects with said discharge port, a piston armature which has a front end and a rear end movably mounted within the solenoid valve, the front end of the piston being capable of controlling the flow area through said flow channel, and electrical means for creating a magnetic field for determining the positioning of said piston within the solenoid valve, and a control means electrically connected to said electrical means for determining the magnetic field generated thereby, said control means receiving signals indicative of said various operating parameters.

2. The governor system as defined in claim 1, wherein said front end of said piston armature has a flat, circular shoulder portion having a predetermined diameter, and wherein said solenoid valve includes an annular seal plate having a circular opening therethrough against which said front end of said piston armature can seat, said flow channel passing through said circular opening, the diameter of the circular opening in said annular seal plate being less than said predetermined diameter of the shoulder portion on the front end of said piston armature.

3. The governor system as defined in claim 2 wherein said solenoid valve includes a housing in which said piston chamber armature and said electrical means are located, a cylindrical member disposed within said housing, said cylindrical member having a first axial end, a second axial end, an axial bore therethrough, a longitudinal groove in the outer surface thereof, and a flange member extending radially outwardly of the second axial end thereof, said flange member including a tapered rim having an apex which can abut against said housing, said axial bore and said longitudinal groove forming a portion of said flow channel, and a connecting flange attached to said housing and capable of pressing said flange member of said cylindrical member such that the tapered rim thereon is pressed against said housing.

4. The governor system as defined in claim 3, wherein said connecting flange includes an inlet port connected to the downstream portion of said pipe means, a first fluid flow duct which extends from said inlet port to an outlet opening opposite the mouth of the axial bore in said cylindrical member at the second axial end thereof, and a second fluid flow duct which has an inlet opening opposite the longitudinal groove in the outer surface of said cylindrical member at the second axial end thereof and extends to said outlet port, said first and second flow ducts forming part of said flow channel.

5. The governor system as defined in claim 2 wherein said solenoid valve further comprises a cylindrical member disposed therein, said cylindrical member comprising a first chambered recess formed in an axial end surface portion thereof, and wherein said front end of said piston armature further comprises a second chamfered recess formed therein.

6. The governor system of claim 1 wherein said diesel engine further comprises a pressure charged engine having a supercharger, wherein said pressurized fluid comprises combustion air compressed by said supercharger and wherein a fixed restrictor element is provided in said upstream portion of said pipe means.

7. The governor system of claim 6 wherein said controlling element comprises a manifold pressure compensator.

* * * * *